United States Patent [19]

Plumadore

[11] Patent Number: 4,461,561

[45] Date of Patent: Jul. 24, 1984

[54] APPARATUS FOR IMAGING AND DEVELOPING ELECTROPHOTOGRAPHIC MICROFORMATS

[75] Inventor: John D. Plumadore, Westfield, Mass.

[73] Assignee: Photon Chroma, Inc., Westfield, Mass.

[21] Appl. No.: 403,807

[22] Filed: Jul. 30, 1982

[51] Int. Cl.[3] ..... G03G 15/00

[52] U.S. Cl. ..... 355/3 R; 355/16

[58] Field of Search ..... 355/3 R, 5, 10, 16, 355/4

[56] References Cited

U.S. PATENT DOCUMENTS

| | | | |
|---|---|---|---|
| 3,694,069 | 9/1972 | Yamaji et al. | 355/16 X |
| 3,795,917 | 3/1974 | Yamaji et al. | 355/10 X |
| 3,880,512 | 8/1973 | Kuehnle | 355/3 R |
| 3,936,178 | 2/1976 | Kuehnle | 355/5 |

*Primary Examiner*—Richard L. Moses

*Attorney, Agent, or Firm*—Schwartz & Weinrieb

[57] ABSTRACT

Apparatus for imaging and developing electrophotographic elements includes a single module (16) within which there is housed three processing stations (18, 20, 22) equidistantly spaced apart at distances corresponding to the distance separating the image frames of an electrophotographic element microformat. The first station (18) charges and exposes a first image frame of the element (12), the second station (20) tones and preliminarily dries the first image frame while a second image frame is located at the first station (18) for charging and exposure, and the third station (22) completes the drying and fuses the first image frame while the second image frame is now toned and partially dried, a new third image frame being presented to the first station (18) for charging and exposure. An intermittent film transport system, not shown, conveys the film element (12) in a unidirectional mode throughout the processing as indicated by the directional arrow (24). The aforenoted inter-station spacing is facilitated by the compact arrangement of the components at the station with the toning components at the second station (20) partially overlapping the charging/exposure components at the first station (18) and the final dry/fuse components at the third station (22). Processing of any particular single image frame of the film element (12) is thus completed in a minimum amount of time as is the processing of a multiplicity of image frames of the element (12) due to the simultaneous processing of the image frames at the three stations (18, 20, 22) in a time-staggered mode.

11 Claims, 1 Drawing Figure

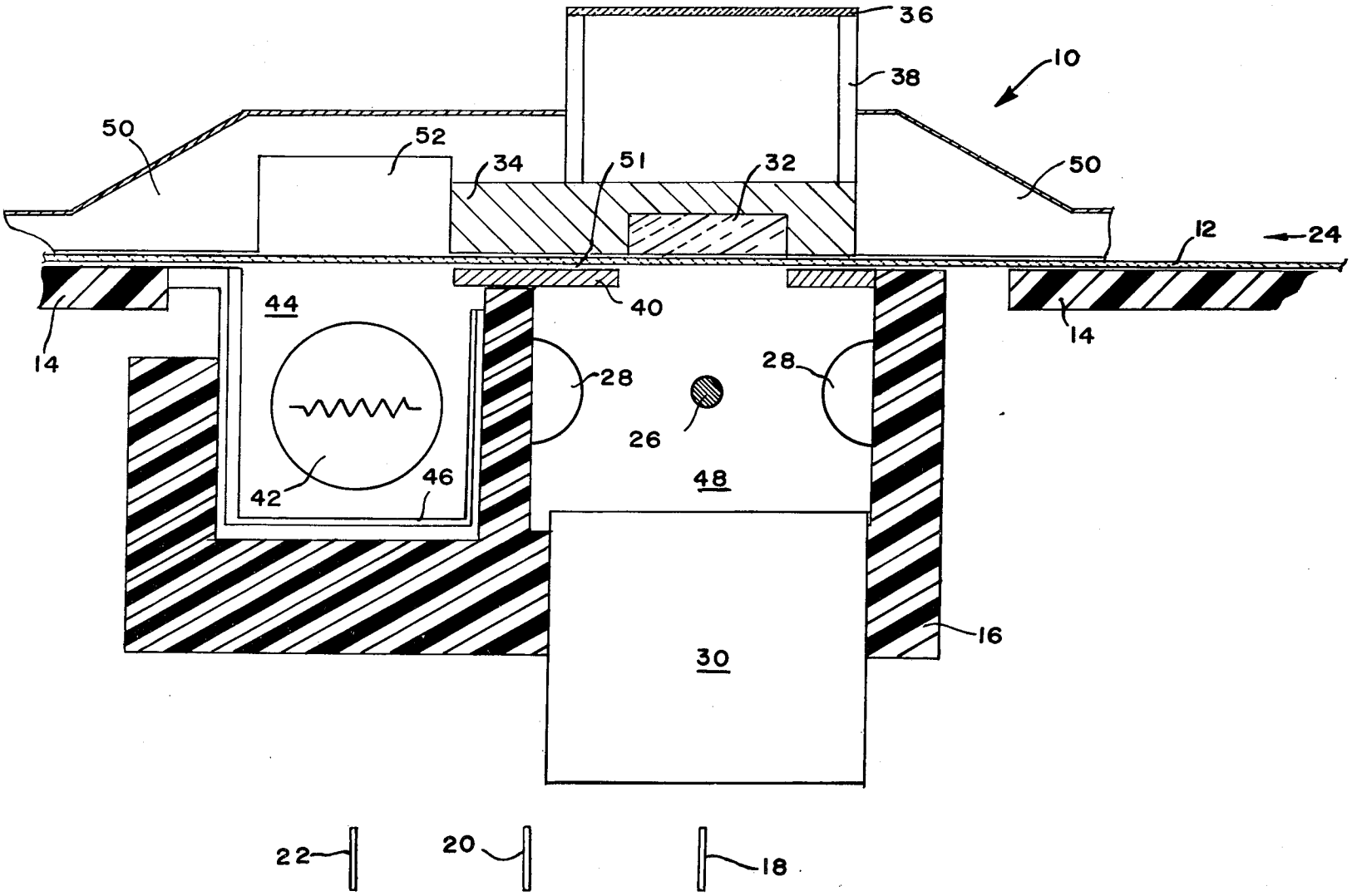
10
12
14
16
18
20
22
24
26
28
30
32
34
36
38
40
42
44
46
48
50
51
52

APPARATUS FOR IMAGING AND DEVELOPING ELECTROPHOTOGRAPHIC MICROFORMATS

TECHNICAL FIELD

The present invention relates generally to electrophotography, and more particularly to apparatus for imaging and developing an electrostatic latent image upon electrophotographic film within a microform system.

BACKGROUND ART

In electrophotography, a uniform electrostatic charge is initially applied to the surface of a photoconductive layer of a film element. This charge is then selectively dissipated in accordance with a particular pattern as determined by exposure of the photoconductive layer surface to a light image. The resulting charge pattern therefore defines an electrostatic latent image upon the photoconductive layer. This latent image may then be rendered visible by applying electrostatically charged toner particles to the photoconductive layer, the toner particles adhering to the photoconductive layer surface by means of electrostatic attraction. In turn, the visible image may now be rendered permanent by subjecting the toner particles to a heating process or treatment which fuses the particles to the photoconductive layer.

As is well-known, in accordance with the conventionally acceptable developing method utilizing a liquid developer or toner, which comprises a liquid carrier for finely divided electrostatic toner particles, such as, for example, carbon particles, suspended therein, the electrophotographic element or image-exposed film is initially dipped within the liquid toner so as to produce the visible image thereon which of course corresponds to the originally defined latent image. While this development method has of course proven to be quite satisfactory for some types of systems and film, it is simply not feasible or applicable for the specialized type of system in which the imaging and developing are to be automatically accomplished within a single piece of apparatus. A microphotographic reproducing machine in which data from successive documents is sequentially recorded upon individual portions or frames of a multiframe microfiche is an exemplary embodiment of the aforenoted specialized type of apparatus.

In addition, in view of the fact that it is desirable to rapidly image and develop each frame prior to, or partially co-extensive with, the processing of the next succeeding frame, the image development process must, of necessity, be one which can be accomplished quickly and conveniently with respect to, for example, a microfiche, strip or roll film, or aperture card, fixed within a suitable holder or support means within the reproduction apparatus. In particular, the processing apparatus or system must be capable of quickly and compactly develop the imaged areas of the microphotograph, including the foregoing electrostatic charging of the microphotograhic image area, exposure of the image area, toning of the image area, and fusing of the image area. Still further, it is highly desirable for the transportation logistics of the film within the system to be simplified so as to achieve a unidirectional processing of the film and its imaged areas whereby the apparatus may be rendered compactly arranged, and the development time for the imaged area, as determined from the initial charging process step to the fusing step, is minimized. In addition, such logistics would also, in turn, permit simultaneous, or time-overlapping development of multiple images upon multiple image areas or frames of, for example, a microfiche, roll film, or the like.

Electrophotographic development apparatus for processing microfiche is currently commercially available as embodied within the System 200 record processor which is manufactured and distributed by A. B. Dick/-Scott of South Hadley, Mass. This system is disclosed within U.S. Pat. No. 3,972,610 issued to Frank C. Gross. While this system is therefore appreciated as being commercially successful as a viable record processor apparatus, it is further appreciated that this system is quite complex and needlessly time-consuming in the development process of not only a single imaged area of a microfiche, for example, but also with respect to the imaging of a plurality of areas to be recorded upon the microfiche or other similar microformats.

In particular, for example, as may best be appreciated from FIG. 15 of U.S. Pat. No. 3,972,610, the development processing apparatus of the System 200 employs separate charge/expose, tone/dry, and fuse modules with respect to which the microfiche is reciprocatingly moved in order to accomplish the various processing steps inherent in the formation of the microfiche imaged areas. More importantly, the reciprocal movement of the microfiche is multi-directional in conjunction with the processing or development of a single imaged area or frame. This is due to the fact that the dry/fuse module is interposed between the charge/expose module and the tone/dry module. Consequently, the development process for a particular frame of the microfiche is quite time-consuming in view of the fact that the modules themselves have to be shifted toward and away from the fiche, and the fiche itself has to be reciprocated laterally in opposite directions in order to be properly aligned with the particular processing module. This lateral, multi-directional shifting of the microfiche relative to the various processing or development modules also prevents the simultaneous or overlapping processing of several microfiche image frames. To the contrary, a second image frame of the System 200 microfiche can only be imaged and developed after a first image frame has been completely imaged and developed. Consequently, the overall processing time for a complete microfiche is seen to be quite expensive.

A need therefore exists for an improved apparatus for imaging and developing electrophotographic microformats wherein the various processing components of the imaging and developing system are compactly arranged so as to reduce the overall size of the apparatus and the through-put processing or development time for a particular imaged area of a microfiche, roll film, or an aperture card. In addition, there is a need for providing such improved apparatus of the foregoing type wherein the movement or transportation of the electrophotographic film element is unidirectional so as to insure the minimization of the development or processing time for a particular imaged area of the film element, and to additionally permit the simultaneous processing of several imaged areas of the film element in a staggered time sequence.

Accordingly, it is an object of the present invention to provide a new and improved apparatus for imaging and developing electrophotographic microformats.

Another object of the present invention is to provide new and improved apparatus for imaging and developing electrophotographic microformats which overcomes the disadvantages and operational drawbacks characteristic of similar conventional apparatus which represents the state of the art of the current technology.

Still another object of the present invention is to provide a new and improved apparatus for imaging and developing electrophotographic microformats which can accurately, economically, and efficiently reproduce documentary material upon such electrophotographic microformats.

Yet another object of the present invention is to provide a new and improved apparatus for imaging and developing electrophotographic microformats which can accurately, economically, and efficiently reproduce documentary material onto selected areas of such electrophotographic microformats, such as, for example, a microfiche, aperture card, roll or strip film, or the like.

Still yet another object of the present invention is to provide a new and improved apparatus for imaging and developing electrophotographic microformats wherein the various processing components of the imaging and developing system are compactly arranged so as to reduce the overall size of the apparatus.

Yet still another object of the present invention is to provide a new and improved apparatus for imaging and developing electrophotographic microformats wherein the various processing components of the imaging and developing system are compactly arranged so as to substantially reduce the through-put processing or development time required for the complete reproduction of an original document image upon the particular area of the microformat element.

A further object of the present invention is to provide a new and improved apparatus for imaging and developing electrophotographic microformats wherein the movement or transportation of the microformat is unidirectional so as to insure the minimization of the development or processing time for a particular imaged area of the microformat or film element.

A still further object of the present invention is to provide a new and improved apparatus for imaging and developing electrophotographic microformats wherein the movement or transportation of the microformat or film element is unidirectional so as to facilitate the simultaneous processing or image development of multiple imaged areas upon the film element in a staggered time sequence.

A yet further object of the present invention is to provide a new and improved apparatus for imaging and developing electrophotographic microformats which can be manufactured substantially less expensively than the similar conventional apparatus which represents the state of the art of current technology.

A still yet further object of the present invention is to provide a new and improved apparatus for imaging and developing electrophotographic microformats wherein the apparatus is substantially simpler in its arrangement of its component parts requisite for the imaging and development of one or more predetermined areas or frames of the microformat film element as compared to the arrangement or disposition of the corresponding components of the conventional state of the art apparatus.

A yet still further object of the present invention is to provide a new and improved apparatus for imaging and developing electrophotographic microformats wherein the transportation logistics of the apparatus of the present invention are substantially simpler and able to be accomplished substantially faster than the corresponding logistics of the conventional state of the art apparatus.

DISCLOSURE OF THE INVENTION

The foregoing and other objectives are achieved in accordance with the present invention through the provision of apparatus for imaging and developing electrophotographic microformats, such as, for example, microfiche, aperture cards, roll or strip film, or the like, which includes a single processing stationary module having a charge/exposure station, a toning/preliminary drying station, and a complete drying/fusing station serially arranged within the module in that respective order. Suitable means is provided for moving or transporting the film element in a frame-by-frame unidirectional stepping mode. The lateral spacing distance defined between the three processing stations corresponds with the spacing distance defined between successive frames of the film element. Consequently, when the film element is transported within and through the processing module, a first frame may be initially disposed at the charge/exposure station. Upon completion of the charging and exposure of the film element, the film element is laterally transported so as to now dispose the first frame of the film element at the toning/preliminary drying station. At this time it will be appreciated, a second frame is now disposed at the charging/exposure station. Consequently, during the time period required for the toning and preliminary drying of the first imaged frame of the film element or microfiche, for example, the second frame image area is being charged and exposed for imaging of a second document or data. In turn, upon completion of the toning and preliminary drying processing of the first imaged frame of the film element, and likewise upon completion of the charging and exposure of the second image frame of the film element within substantially the same time period, the transport means for the film element is again activated and the film element transported laterally a distance corresponding to one additional frame of the film element. In this manner, the first image frame of the film element which has already been toned and preliminarily dried is now disposed at the third or complete drying/fusing station while the second imaged frame of the film element is now disposed at the second toning/preliminary drying station. A third frame area of the film element is now disposed at the first or charge/exposure station. Within the subsequent predetermined time period, therefore, the first frame imaged area is completely dried and fused, the second imaged frame area is toned and preliminarily or partially dried, and the third frame area if charged and exposed. The process is then continued until all of the document or data reproduction has been completed, or alternatively until all of the frames of the film element have been imaged.

The compact arrangement of the processing stations spaced one frame or image area apart is facilitated by the disposition of the charging and exposure components of the system of the present invention partially behind and in overlapping relationship, as viewed in the lateral, transportation direction of the film element, with respect to the toning and preliminary drying components of the system of the present invention. In a similar manner, the complete drying and fusing components of the system of the present invention are disposed partially behind and in lateral overlapping relationships with respect to the toning and preliminary drying components of the system of the present invention.

Thus it may be appreciated that by means of the serial disposition of the three development stations within the single module of the apparatus of the present invention wherein the three processing stations are disposed in a unidirectional arrangement required for processing of the film element, the film element is in fact able to be processed in a unidirectional mode and in the shortest possible time in view of the fact that reciprocal, time-consuming processing movements characteristic of the currently available state of the art apparatus have been eliminated. This is to be further appreciated as being applicable both to the processing or development of a single image frame upon a film element as well as the processing or development of multiple image frames comprising, for example, an entire array defined upon a microfiche. This is obviously due also to the fact multiple image frames may be simultaneously processed in a time-staggered mode. That is, as has been described hereinbefore and as will be described in more detail hereinafter, a second image frame may have its development begun with the charge and exposure portion of the process while the first imaged frame is already being toned and preliminarily dried. In a like manner, the first imaged frame may have its development completed at the complete drying and fusing station while the second image frame is being toned and preliminarily dried and the third frame of the film element is initially being charged and exposed.

BRIEF DESCRIPTION OF THE DRAWINGS

Various other objects, features, and attendant advantages of the present invention will be more fully appreciated as the same becomes better understood from the following detailed description when considered in connection with the accompanying drawing wherein:

The sole FIGURE is a cross-sectional view of the new and improved apparatus for imaging and developing electrophotographic microformats of the present invention showing the cooperative parts thereof during a development process of, for example, a roll film element within a camera/processor with which the imaging and developing apparatus or system of the present invention is operative associated.

BEST MODE FOR CARRYING OUT THE INVENTION

Referring now to the drawing, there is shown the new and improved appartus or system for imaging and developing electrophotographic microformats of the present invention as generally indicated by the reference character 10. It is to be understood that the apparatus or system for imaging and developing electrophotographic microformats 10 of the present invention is to be utilized within camera/processor apparatus for developing an electrostatic latent image upon an electrophotographic element or medium, and in accordance with the particularly disclosed embodiment of the drawing, the element or medium comprises roll or strip film 12 housed within a cassette housing 14. While the particularly disclosed embodiment of the electrophotographic film element 12 comprises a roll or strip of microfilm, it is to be understood that the imaging and developing apparatus or system of the present invention is readily adaptable and useable with any one of several different types of electrophotographic film elements or media, such as, for example, microfiche, aperture cards, and the like. In each instance, a single or multiple images may be developed upon the particular film element in well-known arrays, and the imaging and developing system of the present invention is to be utilized for the complete development of any one of the images of such arrays.

The film cassette 14 is suitably mounted within the entire camera/processor housing, not shown, as is a single development module 16 which houses all of the imaging and developing components comprising the apparatus or system of the present invention for development of the microimages upon the film element 12. In particular, the imaging and developing system or apparatus of the present invention is seen to comprise three stationary processing stations schematically designated at 18, 20, and 22 and serving to define, respectively, the charge/exposure, toning/preliminary drying, and final drying/fusing stations. It is to be appreciated that the three processing stations are equidistantly spaced relative to each other in the lateral direction direction as viewed in the drawing, or alternatively, in the longitudinal direction relative to the directional movement of the film element 12 as the same is being processed as denoted by the arrow 24.

The components of the system of the present invention disposed at the charging/exposure station 18 are seen to comprise a corona wire 26 fabricated, for example, of tungsten, and which is disposed transversely across the width of film 12. Two, semi-cylindrical corona electrodes 28 are disposed upon opposite sides of the corona wire 26 so as to uniformly shape or distribute the charge emanating from the corona wire 26 to the particular image cell or frame of the film element 12 that is to be subsequently imaged and developed. A lens 30 is provided to of course achieve the micro-reduction of the original document when exposure is made of the same by means of a suitable light source, not shown, which may be, for example, one or more xenon flash or tungsten-halogen lamps. The camera/processor may further include a reader projection system which may comprise, for example, a transparent glass plate 32 mounted within a cast aluminum framework 34, and a projection reflecting mirror 36 supported above the image-transmitting glass plate 32 by means of a suitable support system 38, however, this reader projection system does not form any part of the imaging and developing system or apparatus which is the subject matter of this patent application.

The toning station 20 apparatus is seen to comprise, as schematically disclosed, a toning head 40 which may include, in part, the development electrode, and it is to be specifically noted as one of the primary features of the present invention system that the toning station apparatus including the toning head 40 partially overlaps the charging and exposure apparatus of charge/exposure station 18 as viewed in the lateral spacing direction or alternatively in the longitudinal direction as considered along the movement path of the film 12 as denoted by arrow 24. Stated alternatively, it is seen, for example, that the left one of the semi-cylindrical corona electrodes 28 is disposed below or transversely behind the right portion of the toning head 40 as again considered from the viewpoint of the longitudinal movement direction of the film 12 as denoted by arrow 24. In this manner, the apparatus components comprising the charge/exposure and toning/drying stations are able to be compactly arranged with respect to each other.

In a similar manner, the complete drying/fusing station 22 apparatus is seen to comprise a suitable heat source 42 which may be, for example, a tungsten halogen lamp. The lamp 42 is disposed within a heating or fusing chamber 44 within which there is also disposed suitable reflector means 46 for concentrating the drying and fusing heat from lamp 42 onto the particular image frame of film 12 which is being dried and fused at station 22. As is evident from the drawing figure, the toning head 40 component of the toning station 20 apparatus extends laterally into the fusing chamber 44 so as to partially overlap the right hand or sidewall portion of reflector 46. Stated otherwise, the right hand or sidewall portion of reflector 46 is seen to be disposed behind the left side portion of toning head 40. Consequently, the apparatus components comprising the toning/-preliminary drying and complete drying/fusing stations are able to be compactly arranged with respect to each other.

During the processing of the film 12 and the individual image frames defined thereon, a first frame of the film element 12 will be initially disposed at the charge/exposure station 18, and after a suitable input command is initiated by an operator with respect to the control mechanisms and circuitry, not shown, comprising the camera/processor, the charge and exposure portion of the imaging and development process will commence. The corona wire 26 will be energized and the electrostatic charge will be uniformly applied to the film element 12 image frame as determined by means of the corona electrodes 28. After a predetermined short period of time, the corona wire will be de-energized and exposure of the charged film element 12 image frame with an image of the original document or data to be micro-reproduced upon film element 12 will be projected by means of lens 30, as well as a suitable optical and illumination system, not shown. The exposure of the charged image frame of the film element 12 may be accomplished by energizing the lamp source, not shown, subsequent to the de-energization of the charging corona wire 26, or alternatively, both the corona wire 26 and the image exposute lamp source, not shown, may be simultaneously energized, actual image exposure of the film element 12 charged frame being accomplished upon termination of the energization or de-energization of the corona wire.

Upon completion of the charging and exposure of the aforenoted film element 12 image frame, the film 12 is advanced by suitable film transport means, not shown, so as to disposed the charged and exposed-imaged film element 12 frame opposite the toning head 40 of the toning station 20. At the same time, it will of course be appreciated, a new second frame of the film element 12 has now been disposed at the charge/exposure station 18. During the advancement of the film element 12, the exposure lamp, not shown, will have been de-energized so as not to impress any images upon the film 12 while the same is being transported and until the next frame thereof is properly located at the charge/exposure station 18. Upon cessation of the film transport means, not shown, which is operable in an intermittent manner as will by now have been appreciated, the control mechanisms or systems, and its associated electronic circuitry, not shown, of the camera/processor will cause liquid toner to flow over the film 12 and the development electrode disposed at the toning station 20 so as to commence the actual development cycle of the imaging and developing process. The toner flow control system of the camera/processor is more particularly described in applicant's co-pending patent application entitled INCLINED TONER FLOW CONTROL SYSTEM FOR DEVELOPING AN ELECTROSTATIC LATENT IMAGE UPON AN ELECTROPHOTOGRAPHIC FILM and which application was filed on the same date as the present application. As more particularly described in the co-pending patent application, the cavity or chamber 48 within which the corona wire 26 and the corona electrodes 28 are disposed, as well as fusing chamber 44, is provided with positive pressure air which not only serves to properly seat the film element 12 at, for example, the charge/exposure and toning/preliminary drying stations 18 and 20, respectively, or to aid in the definition of the toner cell, but more importantly, such air serves to preliminarily dry the toned image frame disposed at the toning/preliminary drying station 20. Consequently, after the toner flow for toning the image frame of the film element disposed at station 20 has been terminated after a predetermined time period, the positive pressure air disposed within chambers 44 and 48, as well as within the channel 50 defined between the film element 12 and the toning head 40, will preliminarily or partially dry the toner upon the toned image frame of the film element 12 such that the image that has been impressed thereon is now disposed in a stable state. At the same time that the toning and preliminary drying of the first imaged frame of film element 12 disposed at toning/preliminary drying station 20 is taking place, it will be appreciated that the second image frame of film element 12 disposed at the charge/exposure station will be charged and exposed.

In turn, therefore, upon completion of the toning and preliminary drying operation at the second toning/-preliminary drying station 20 in connection with the first imaged frame of film element 12, as well as completion of the charging and exposure operation at the first charge/exposure station 18 in connection with the second imaged frame of the film element 12, the film transport means is again energized so as to transport the film element 12 in the direction of arrow 24 whereby the first imaged and toned frame of film element 12 will now be disposed at the final drying/fusing station 22, the second imaged frame of film element 12 will now be disposed at the tone/preliminary drying station 20, and a new third frame of film element 12 will now be disposed at the charge/exposure station 18. After the transport means has been de-energized and the film element with its image frames are properly disposed at their respective stations, the final drying and fusing lamp 42 will be energized at the final drying/fusing station 22 whereby the first toned and preliminarily dried image frame of film element 12 will be completely dried and fused. While the heat source 42 has been noted as being a single lamp source such as, for example, a tungsten halogen lamp which is capable of accomplishing both the final drying and fusing operations, the heat source 42 may be replaced by means of a lower-power tungsten halogen lamp, not shown, which may be energized to accomplish the final drying or warming process of the film 12, whereupon a low-power xenon flash lamp may be subsequently energized to accomplish the fusing operation of the development process.

Within the support apparatus schematically designated at 50 comprising a portion of the camera/processor which supports the projection reader components 32–38, there is also defined an air chamber 52 to which is supplied positive pressure air having a flow rate substantially greater than that of the air within chambers 44 and 48 as aforenoted. This air chamber 52 is aligned with the final dry/fusing station 22 and is disposed upon the opposite side of the film element 12 as compared to the disposition of chamber 44 relative to film element 12. This higher velocity air flow within chamber 52 serves to cool the base or substrate of the film element 12 during the fusing and final drying process such that, for example, the film is in fact properly dried and the image properly fused without distortion or buckling problems being impressed upon the film element. During the final drying and fusing process being accomplished with respect to the first imaged frame of film element 12 at station 22, it will of course be realized that toning and preliminary drying are being simultaneously accomplished at station 20 upon the second image frame of film element 12, while charging and exposure of the third image frame of film element 12 is being accomplished at the first charge/exposure station 18.

Thus it may be seen that as a result of the compact arrangement of the three processing stations of the systems of the present invention which comprises the disposition of the three stations, relative to each other, at equidistant locations corresponding to one image frame step of the film element, and the disposition of the three processing stations in the order of film processing, a unidirectional processing of the film element is able to be accomplished for one or more image frames of the film element. In addition, as a result of the foregoing unidirectional processing, as well as the disposition of the processing stations one image frame distance apart, multiple image frames may be simultaneously processed in a time-staggered mode, that is, the first image frame will have been completed when the second frame is at a mid-point of its processing and while a third frame is just commencing processing. In addition, it is also noted that should only a single image frame be processed by means of suitable operator control commands, the entire processing of this single image frame will be completed, without processing being energized for subsequent image frames, prior to, for example, removal of the film element from the camera/processor being permitted.

Obviously, many modifications and variations of the present invention are possible in light of the above teachings. It is therefore to be understood that within the scope of the appended claims, the present invention may be practiced otherwise than as specifically described herein.

I claim:

1. Apparatus for imaging and developing electrophotographic elements, comprising:

an electrophotographic element for having one or more image frames developed thereon;

a single module disposed adjacent to said electrophotographic element and including a first charge/exposure station, a second tone/preliminary dry station, and a third final dry/fuse station;

said first, second, and third stations being compactly arranged with respect to each other so as to be disposed equidistantly apart at locations corresponding to the distance spacings defined between said one or more image frames defined upon said electrophotographic element;

means for causing relative movement between said electrophotographic element and said module; and said stations being arranged in the order of said numerical order of said stations such that the processing of said electrophotographic element is attained by a unidirectional relative movement between said electrophotographic element and said module so as to facilitate the simultaneous processing of said one or more image frames in a time-staggered mode.

2. Apparatus for imaging and developing electrophotographic elements, comprising:

an electrophotographic element for having one or more image frames developed thereon;

a single module disposed adjacent to said electrophotographic element and including a first charge/exposure station having a predetermined lateral extent, a second tone/preliminary dry station having a predetermined lateral extent, and a third final dry/fuse station;

said second tone/preliminary dry station being disposed relative to said first charge/exposure station such that the tone components of said second tone/preliminary dry station, having said predetermined lateral extent, partially overlap said lateral extent of said first charge/exposure station so as to compactly arrange said first, second, and third stations with respect to each other in equidistantly spaced apart locations corresponding to the distance spacings defined between said one or more image frames defined upon said electrophotographic element;

means for causing relative movement between said electrophotographic element and said module; and said stations being arranged in the order of said numerical order of said stations such that the processing of said electrophotographic element is attained by a unidirectional relative movement between said electrophotographic element and said module so as to facilitate the simultaneous processing of said one or more image frames in a time-staggered mode.

3. Apparatus for imaging and developing electrophotographic elements, comprising:

an electrophotographic element for having one or more image frames developed thereon;

a single module disposed adjacent to said electrophotographic element and including a first charge/exposure station, a second tone/preliminary dry station having a predetermined lateral extent, and a third final dry/fuse station having a predetermined lateral extent;

said second tone/preliminary dry station being disposed relative to said third final dry/fuse station such that the tone components of said second tone/preliminary dry station, having said predetermined lateral extent, partially overlap said predetermined lateral extent of said third final dry/fuse station so as to compactly arrange said first, second, and third stations with respect to each other in equidistantly spaced apart locations corresponding to the distance spacings defined between said one or more image frames defined upon said electrophotographic element;

means for causing relative movement between said electrophotographic element and said module; and said stations being arranged in the order of said numerical order of said stations such that the processing of said electrophotographic element is attained by a unidirectional relative movement between said electrophotographic element and said module so as to facilitate the simultaneous processing of said one or more image frames in a time-staggered mode.

4. Apparatus for imaging and developing electrophotographic elements, comprising:

an electrophotographic element for having one or more image frame developed thereon;

a single module disposed adjacent to said electrophotographic element and including a first charge/exposure station having a predetermined lateral extent, a second tone/preliminary dry station having a predetermined lateral extent, and a third final dry/fuse station having a predetermined lateral extent;

said second tone/preliminary dry station being disposed relative to said first charge/exposure station and said third final dry/fuse station such that the tone components of said second tone/preliminary dry station, having said predetermined lateral extent, partially overlap both said predetermined lateral extents of said first charge/exposure station and said third final dry/fuse station so as to compactly arrange said first, second, and third stations with respect to each other in equidistantly spaced apart locations corresponding to the distance spacings defined between said one or more image frames defined upon said electrophotographic element;

means for causing relative movement between said electrophotographic element and said module; and said stations being arranged in the order of said numerical order of said stations such that the processing of said electrophotographic element is attained by a unidirectional relative movement between said electrophotographic element and said module so as to facilitate the simultaneous processing of said one or more image frames in a time-staggered mode.

5. Apparatus as set forth in claim 1, wherein:

said relative movement defined between said electrophotographic element and said module is intermittently achieved so as to provide for processing of said electrophotographic element at each of said first, second, and third stations.

6. Apparatus as set forth in claim 2, wherein:

said charge and expose components of said first station and said tone components of said second station partially overlap each other as viewed in the direction of the movement of said electrophotographic element.

7. Apparatus as set forth in claim 3, wherein:

said final dry and fuse components of said third station and said tone components of said second station partially overlap each other as viewed in the direction of the movement of said electrophotographic element.

8. Apparatus as set forth in claim 4, wherein:

said charge and expose components of said first station and said final dry and fuse components of said third station partially overlap said tone components of said second station as viewed in the direction of the movement of said electrophotographic element.

9. Apparatus as set forth in claim 1, wherein:

said electrophotographic element is a microfiche.

10. Apparatus as set forth in claim 1, wherein:

said electrophotographic element is an aperture card.

11. Apparatus as set forth in claim 1, wherein:

said electrophotographic element is a roll of microfilm.

* * * * *